US010099894B2

(12) United States Patent
Roberts et al.

(10) Patent No.: US 10,099,894 B2
(45) Date of Patent: Oct. 16, 2018

(54) ACTIVE DAMPING OF A HOVERING ELEVATOR CAR BASED ON VERTICAL OSCILLATION OF THE HOVERING ELEVATOR CAR

(71) Applicant: Otis Elevator Company, Farmington, CT (US)

(72) Inventors: Randall K. Roberts, Hebron, CT (US); Amir Lotfi, South Windsor, CT (US); Ismail Agirman, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 468 days.

(21) Appl. No.: 14/772,211

(22) PCT Filed: Mar. 7, 2013

(86) PCT No.: PCT/US2013/029616

§ 371 (c)(1),
(2) Date: Sep. 2, 2015

(87) PCT Pub. No.: WO2014/137345

PCT Pub. Date: Sep. 12, 2014

(65) Prior Publication Data

US 2016/0023864 A1 Jan. 28, 2016

(51) Int. Cl.
*B66B 1/34* (2006.01)
*B66B 1/44* (2006.01)
(Continued)

(52) U.S. Cl.
CPC ..... *B66B 1/44* (2013.01); *B66B 1/28* (2013.01); *B66B 1/3492* (2013.01); *B66B 1/40* (2013.01)

(58) Field of Classification Search
CPC ..... B66B 1/44; B66B 1/28; B66B 1/3492; B66B 1/40
(Continued)

(56) References Cited

U.S. PATENT DOCUMENTS 4,030,570 A 6/1977 Caputo
4,570,755 A * 2/1986 Tsai ..... B66B 1/36 187/284
(Continued)

FOREIGN PATENT DOCUMENTS

EP 1584597 10/2005
JP 07257831 10/1995
(Continued)

OTHER PUBLICATIONS

Extended EP Search Report dated Nov. 24, 2016.

*Primary Examiner* — Anthony Salata
(74) *Attorney, Agent, or Firm* — O'Shea Getz P.C.

(57) ABSTRACT

A system and a method are provided for damping vertical oscillations of an elevator car hovering at an elevator landing. The system includes a sensor, a controller and an elevator machine connected to a traction sheave. The sensor is adapted to provide a sensor signal indicative of rotation of the traction sheave, wherein the rotation of the traction sheave corresponds to the vertical oscillations of the hovering elevator car. The controller is adapted to provide a control signal based on the sensor signal. The elevator machine is adapted to reduce the vertical oscillations of the hovering elevator car by controlling the rotation of the traction sheave based on the control signal.

20 Claims, 5 Drawing Sheets

(51) Int. Cl.
*B66B 1/28* (2006.01)
*B66B 1/40* (2006.01)

(58) Field of Classification Search
USPC ..... 187/247, 281, 284, 289, 291, 293, 295, 187/297, 391, 393, 288, 292
See application file for complete search history.

(56) References Cited

U.S. PATENT DOCUMENTS 5,677,519 A * 10/1997 Herkel ..... B66B 1/3492 187/283
6,202,796 B1 * 3/2001 Lee ..... B66B 1/30 187/284
6,283,252 B1 9/2001 Lee
6,311,802 B1 * 11/2001 Choi ..... G05B 19/416 187/291
6,488,128 B1 12/2002 Slabinski
7,621,377 B2 11/2009 Husmann
7,775,330 B2 * 8/2010 Kattainen ..... B66B 5/04 187/287
8,365,873 B2 * 2/2013 Viita-Aho ..... B66B 5/0031 187/314
8,746,411 B2 * 6/2014 Roberts ..... B66B 17/34 187/393
8,869,945 B2 * 10/2014 Harkonen ..... B66B 1/28 187/288
9,422,133 B2 * 8/2016 Rebillard ..... B66B 1/32
9,663,323 B2 * 5/2017 Stolt ..... B66B 1/30
9,828,211 B2 * 11/2017 Schonauer ..... B66B 1/40
2006/0113148 A1 * 6/2006 DeLange ..... B66B 1/30 187/284
2010/0294598 A1 11/2010 Roberts

FOREIGN PATENT DOCUMENTS

JP H08310749 11/1996
JP H09290965 11/1997
JP 2001122538 5/2001
JP 2003095546 4/2003
JP 2010280458 12/2010
JP 2011063427 3/2011
JP 2011111303 6/2011

* cited by examiner

ACTIVE DAMPING OF A HOVERING ELEVATOR CAR BASED ON VERTICAL OSCILLATION OF THE HOVERING ELEVATOR CAR

This application claims priority to PCT Patent Appln. No. PCT/US13/29616 filed Mar. 7, 2013.

BACKGROUND OF THE INVENTION

1. Technical Field

This disclosure relates generally to an elevator and, more particularly, to a system and method for damping vertical oscillations of an elevator car.

2. Background Information

An elevator typically includes a plurality of belts or ropes that move an elevator car vertically within a hoistway between a plurality of elevator landings. When the elevator car is hovering at a respective one of the elevator landings, changes in magnitude of a load within the car can cause changes in vertical position of the car relative to the landing. The elevator car can move vertically down relative to the elevator landing, for example, when one or more passengers and/or cargo move from the landing into the car. In another example, the elevator car can move vertically up relative to the elevator landing when one or more passengers and/or cargo move from the car onto the landing. Such changes in the vertical position of the elevator car can be caused by soft hitch springs and/or stretching and/or contracting of the belts or ropes, particularly where the elevator has a relatively large travel height and/or a relatively small number of belts or ropes. Under certain conditions, the stretching and/or contracting of the belts or ropes and/or hitch springs can create disruptive oscillations in the vertical position of the elevator car; e.g., an up and down car motion.

SUMMARY OF THE DISCLOSURE

According to an aspect of the invention, a system is provided for damping vertical oscillations of an elevator car hovering at an elevator landing. The system includes a sensor, a controller and an elevator machine connected to a traction sheave. The sensor is adapted to provide a sensor signal indicative of rotation of the traction sheave, wherein the rotation of the traction sheave corresponds to the vertical oscillations of the hovering elevator car. The controller is adapted to provide a control signal based on the sensor signal. The elevator machine is adapted to reduce the vertical oscillations of the hovering elevator car by controlling the rotation of the traction sheave based on the control signal.

Alternatively or in addition to this or other aspects of the invention, the controlling of the rotation of the traction sheave with the elevator machine may (e.g., continuously) drive the sensor signal towards a baseline. For example, the controlling of the rotation of the traction sheave with the elevator machine may drive the sensor signal to the baseline. Alternatively or in addition, the controlling of the rotation of the traction sheave with the elevator machine may drive the sensor signal to within a baseline range that includes the baseline. The sensor signal may oscillate within the baseline range.

Alternatively or in addition to this or other aspects of the invention, the sensor signal may be indicative of an angular position of the traction sheave. The baseline may indicative of an angular baseline position.

Alternatively or in addition to this or other aspects of the invention, the sensor signal may be indicative of an angular velocity of the traction sheave. The baseline may be indicative of a substantially zero angular velocity.

Alternatively or in addition to this or other aspects of the invention, the elevator machine may include a brake. The controller may be adapted to signal the brake to substantially prevent rotation of the traction sheave where the hovering elevator car is at an upper floor in the hoistway. The controller may be adapted to provide the control signal to the elevator machine where the hovering elevator car is at a lower floor in the hoistway, which is located vertically below the upper floor.

Alternatively or in addition to this or other aspects of the invention, the elevator machine may include a brake. The controller may be adapted to signal the brake to substantially prevent rotation of the traction sheave where a door of the hovering elevator car is closed. The controller may be adapted to provide the control signal to the elevator machine where the door of the hovering elevator car is open.

Alternatively or in addition to this or other aspects of the invention, the elevator machine may include a brake. The controller may be adapted to signal the brake to substantially prevent rotation of the traction sheave where the sensor signal is within a threshold range. The controller may be adapted to provide the control signal to the elevator machine where the sensor signal is outside of the threshold range.

Alternatively or in addition to this or other aspects of the invention, the elevator machine may include a brake. The controller may be adapted to signal the brake to substantially prevent rotation of the traction sheave where a change in a weight of the hovering elevator car is below a threshold. The controller may be adapted to provide the control signal to the elevator machine where the change in the weight of the hovering elevator car is above the threshold.

Alternatively or in addition to this or other aspects of the invention, the elevator machine may include a brake. The controller may be adapted to signal the brake to substantially prevent rotation of the traction sheave where the elevator machine has been controlling the rotation of the traction sheave more than a predetermined period of time.

Alternatively or in addition to this or other aspects of the invention, the sensor may be configured as or include a rotor sensor, a car sensor and/or a counterweight sensor.

According to another aspect of the invention, a method is provided for damping vertical oscillations of an elevator car hovering at an elevator landing. Rotation of a traction sheave connected to an elevator machine corresponds to the vertical oscillations of the hovering elevator car. The method includes steps of: (a) receiving a sensor signal indicative of the rotation of the traction sheave; (b) processing the sensor signal with a controller to provide a control signal to the elevator machine; and (c) reducing the vertical oscillations of the hovering elevator car by controlling the rotation of the traction sheave with the elevator machine based on the control signal.

Alternatively or in addition to this or other aspects of the invention, the controlling of the rotation of the traction sheave with the elevator machine may (e.g., continuously) drive the sensor signal towards a baseline. For example, the controlling of the rotation of the traction sheave with the elevator machine may drive the sensor signal to the baseline. Alternatively or in addition, the controlling of the rotation of the traction sheave with the elevator machine may drive the sensor signal to within a baseline range that includes the baseline. The sensor signal may oscillate within the baseline range.

Alternatively or in addition to this or other aspects of the invention, the sensor signal may be indicative of an angular velocity of the traction sheave. The baseline may be indicative of an angular baseline position.

Alternatively or in addition to this or other aspects of the invention, the sensor signal may be indicative of an angular velocity of the traction sheave. The baseline may be indicative of a substantially zero angular velocity.

Alternatively or in addition to this or other aspects of the invention, the method may include a step of substantially preventing rotation of the traction sheave with a brake where the hovering elevator car is at an upper floor within the hoistway. The elevator machine may control the rotation of the traction sheave based on the control signal where the hovering elevator car is at a lower floor within the hoistway, which is located below the upper floor.

Alternatively or in addition to this or other aspects of the invention, the method may include a step of substantially preventing rotation of the traction sheave with a brake where a door of the hovering elevator car is closed. The elevator machine may control the rotation of the traction sheave based on the control signal where the door of the hovering elevator car is open.

Alternatively or in addition to this or other aspects of the invention, the method may include a step of substantially preventing rotation of the traction sheave with a brake where the sensor signal is within a threshold range. The elevator machine may control the rotation of the traction sheave based on the control signal where the sensor signal is outside of the threshold range.

Alternatively or in addition to this or other aspects of the invention, the method may include a step of substantially preventing rotation of the traction sheave with a brake where a change in a weight of the hovering elevator car is below a threshold. The elevator machine may control the rotation of the traction sheave based on the control signal where the change in the weight of the hovering elevator car is above the threshold.

Alternatively or in addition to this or other aspects of the invention, the method may include a step of substantially preventing rotation of the traction sheave with a brake where the elevator machine has been controlling the rotation of the traction sheave more than a predetermined period of time.

Alternatively or in addition to this or other aspects of the invention, the sensor signal may be provided by a sensor that is configured as or includes a rotor sensor, a car sensor and/or a counterweight sensor.

The foregoing features and the operation of the invention will become more apparent in light of the following description and the accompanying drawings.

DETAILED DESCRIPTION OF THE INVENTION

Figure 1:
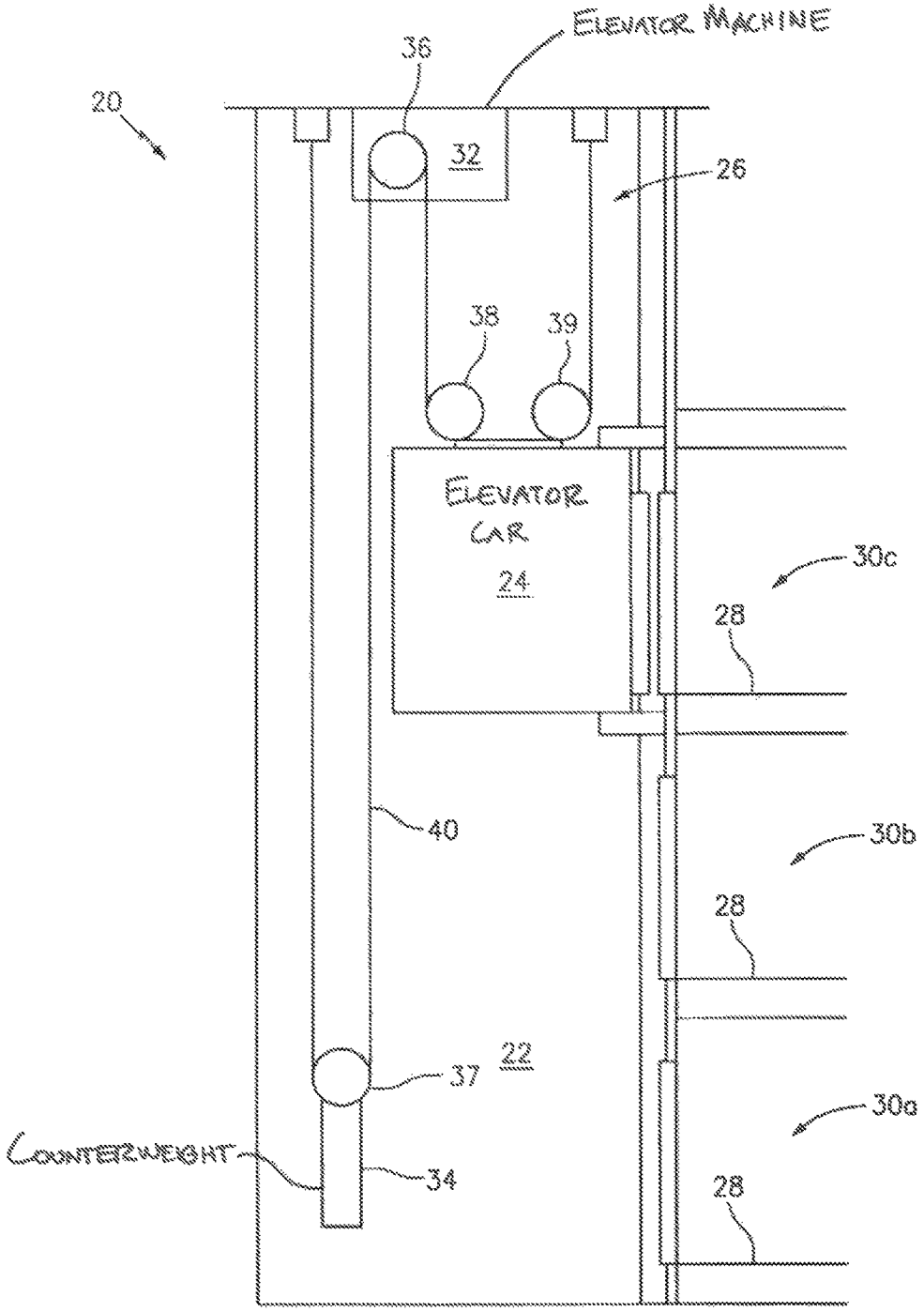
FIG. 1 is a schematic illustration of a traction elevator arranged within a hoistway of a building.

FIG. 1 is a schematic illustration of a traction elevator 20 arranged within a hoistway 22 of a building. The elevator 20 includes an elevator car 24 and an elevator drive system 26 that moves the elevator car 24 vertically within the hoistway 22 between a plurality of elevator landings 28. Each of the elevator landings 28 is located at a respective floor 30*a*, 30*b*, 30*c* of the building.

Figure 2:
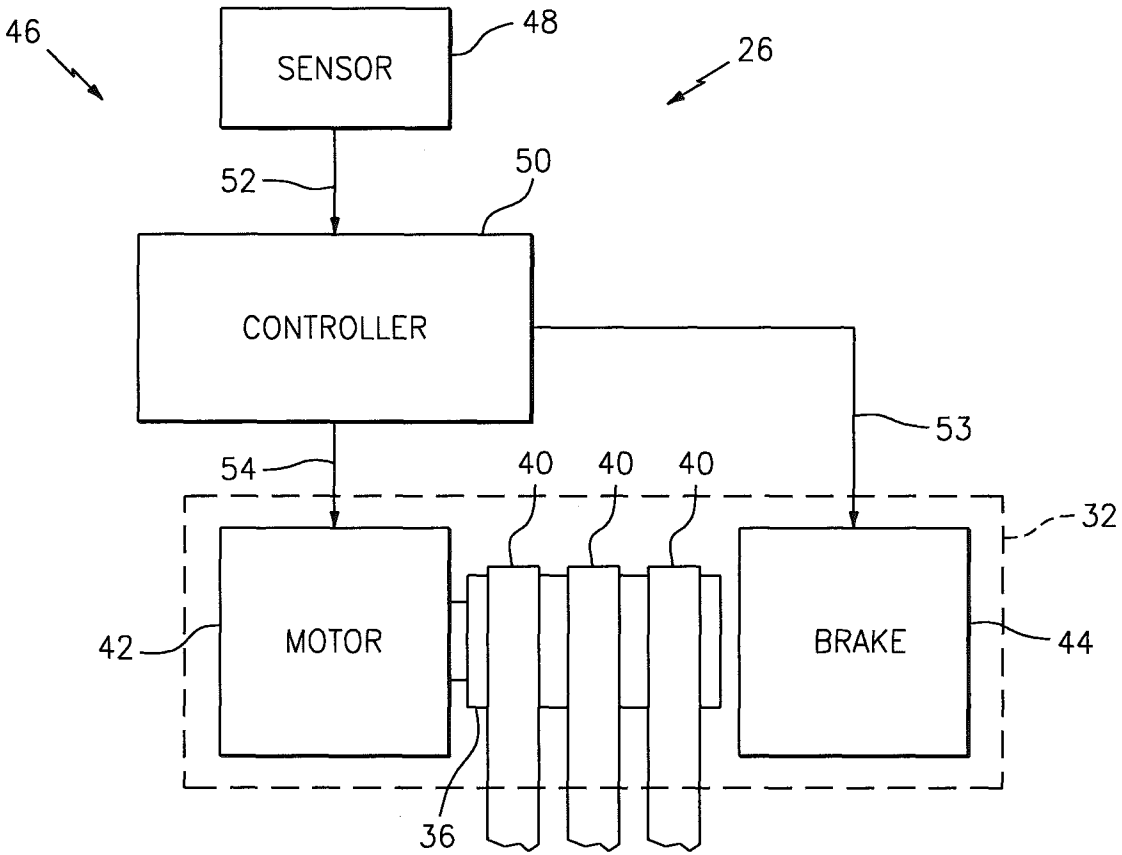
FIG. 2 is a block diagram of an elevator drive system for the elevator of FIG. 1.

The elevator drive system 26 includes an elevator machine 32, a counterweight 34, a traction sheave 36, one or more idler sheaves 37-39, and one or more load bearing members 40; e.g., ropes, belts, cables, etc. Referring to FIG. 2, the elevator machine 32 includes a motor 42 and a brake 44. The traction sheave 36 is rotatably connected to (e.g., between) the motor 42 and the brake 44. Referring again to FIG. 1, the idler sheave 37 is rotatably connected to the counterweight 34. The idler sheaves 38 and 39 are rotatably connected to the elevator car 24. The load bearing members 40 are wrapped (e.g., serpentine) around the sheaves 36-39. The load bearing members 40 connect the elevator car 24 to the elevator machine 32 and the counterweight 34.

Referring to FIG. 2, the elevator drive system 26 also includes a control system 46 that is in signal communication (e.g., hardwired and/or wirelessly connected) with the elevator machine 32. The control system 46 includes a sensor 48 and a controller 50.

The sensor 48 is adapted to provide a sensor signal 52 indicative of rotation of the traction sheave 36. The sensor signal 52 may include, for example, data indicative of an angular (e.g., rotational) velocity of the traction sheave 36 and/or data indicative of an angular position of the traction sheave 36. The sensor signal 52 may also or alternatively include data indicative of a vertical velocity and/or a vertical position of the elevator car 24 and/or the counterweight 34 since the rotation of the traction sheave 36 may correspond (e.g., relate) to vertical movement of the elevator car 24 and/or the counterweight 34.

The sensor 48 may be configured as a rotor sensor that determines a relative angular position and/or velocity of a rotor (e.g., a coil) in the elevator machine 32, which may directly correspond to the angular position and/or velocity of the traction sheave 36. Alternatively, the sensor 48 may be configured as a car sensor that detects vertical position and/or velocity of the elevator car 24, and/or a counterweight sensor that detects a vertical position and/or a velocity of the counterweight 34. The sensor 48 may include a proximity sensor, an optical sensor, a touch sensor, a magnetic sensor, a near field sensor, an accelerometer arranged with the elevator car 24, etc. The present invention, however, is not limited to any particular sensor types or configurations. In addition, the sensor 48 may include a plurality of sub-sensors that monitor various characteristics of the traction sheave 36, the elevator machine 32, the elevator car 24, the counterweight 34 and/or any other component of the elevator 20.

The controller 50 may be implemented with hardware, software, or a combination of hardware and software. The hardware may include one or more processors, memory, analog and/or digital circuitry, etc. The controller 50 is in signal communication with the sensor 48 as well as with the motor 42 and the brake 44.

Figure 3:
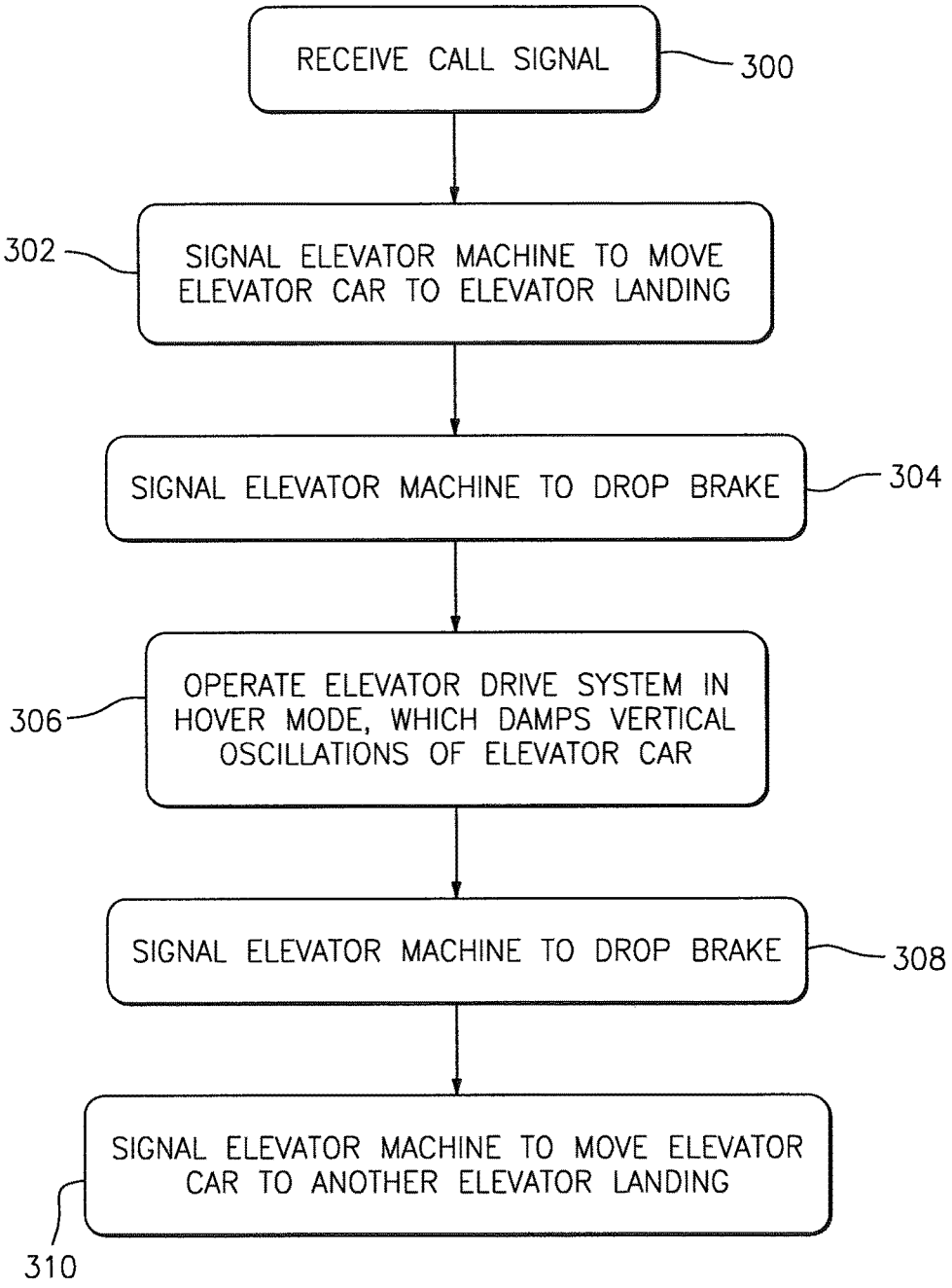
FIG. 3 is a flow diagram of a method for operating the elevator drive system of FIGS. 1 and 2.

FIG. 3 is a flow diagram of a method for operating the elevator drive system 26 of FIGS. 1 and 2. In step 300, the controller 50 receives a call signal from the elevator landing 28 on one of the floors. In step 302, the controller 50 signals the elevator machine 32 to move the elevator car 24 to the elevator landing 28 from which the call signal was received. The motor 42, for example, rotates the traction sheave 36 to move the load bearing members 40 about the idler sheaves 37-39. The movement of the load bearing members 40 causes the elevator car 24 and the counterweight 34 to respectively move (e.g., lift or lower) vertically within the hoistway 22 to the elevator landing 28.

In step 304, the controller 50 signals the elevator machine 32, via a first control signal 53, to drop or otherwise engage the brake 44 after the elevator car 24 has arrived at the elevator landing 28. This dropping of the brake 44 substantially prevents the traction sheave 36 from rotating. The controller 50 may subsequently perform one or more "pre-flight checks" in order to determine whether the elevator 20 is ready for continued operation. Alternatively, these pre-flight checks may be performed during another step of or omitted from this method. Such preflight checks are generally known in the art and therefore are not discussed in further detail.

In step 306, the elevator drive system 26 is operated in a "hover mode". The controller 50 signals the elevator machine 32 to lift or otherwise disengage the brake 44. The controller 50 thereafter utilizes the sensor 48 and the motor 42 in a feedback loop to maintain the traction sheave 36 at or about a substantially constant angular position and/or velocity. The sensor 48, for example, provides the sensor signal 52 to the controller 50. The controller 50 subsequently signals the motor 42, via a second control signal 54, to maintain the traction sheave 36 at an angular baseline velocity and/or at an angular baseline position. The baseline velocity may be a substantially zero angular velocity. The baseline position may be an angular position that corresponds with the elevator car 24 being vertically aligned with the elevator landing 28. By maintaining the traction sheave 36 at or about the baseline velocity and/or position, the motor 42 may substantially prevent the traction sheave 36 from rotating and, thus, the elevator car 24 from moving vertically within the hoistway 22 while hovering (e.g., sopped at the landing).

During the hover mode, one or more passengers and/or cargo may move between the elevator car 24 and the elevator landing 28. This movement may change a magnitude of an overall load (e.g., weight) of the elevator car 24. The movement therefore may also cause the load bearing members 40 supporting the weight of the elevator car 24 to longitudinally stretch and/or contract in a dynamic manner. The load bearing members 40 may stretch, for example, where passengers and/or cargo move from the elevator landing 28 into the elevator car 24 since the weight of the passengers and/or cargo is added to the weight of the elevator car 24. Alternatively, the load bearing members 40 may contract when the passengers and/or cargo move from the elevator car 24 onto the elevator landing 28 since the weight of the passengers and/or the cargo is subtracted from the overall weight of the elevator car 24.

Under certain conditions, the stretching and/or contracting of the load bearing members 40 may cause the elevator car 24 to vertically oscillate (e.g., move up and down) relative to the elevator landing 28. These vertical oscillations may be unnerving for the passengers in the elevator car 24 as well as create potential injury hazards (e.g., tripping hazards, etc.) for passengers entering or leaving the elevator car 24 or individuals loading or unloading cargo. The elevator drive system 26 of FIGS. 1 and 2, however, may reduce or substantially prevent these vertical oscillations of the elevator car 24 using the feedback loop of the hover mode.

The vertical oscillations of the elevator car 24 may cause the traction sheave 36 to rotate back and forth about its axis. These rotational oscillations of the traction sheave 36 in turn may cause the sensor signal 52 to oscillate (e.g., increase and decrease) or otherwise change over time. The sensor signal 52, for example, may increase when the traction sheave 36 rotates in an angular first (e.g., clockwise) direction. The sensor signal 52 may decrease when the traction sheave 36 rotates in an angular second (e.g., counter-clockwise) direction.

Figure 4:
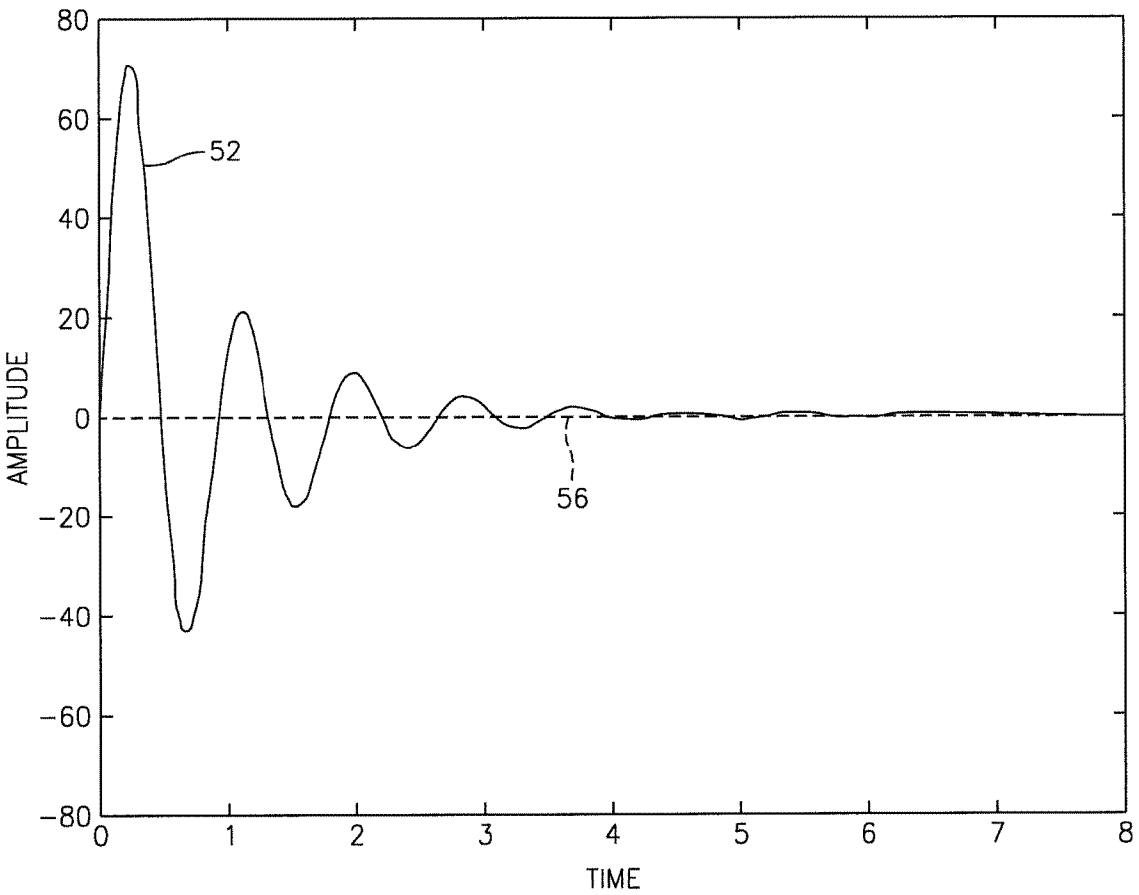
FIG. 4 is a graphical depiction of an amplitude of changes in a traction sheave angular position versus time during a hover mode of operation.

Based on the oscillating sensor signal 52, the controller 50 signals the motor 42 to control the rotation of the traction sheave 36 in a manner that (e.g., continuously) drives the sensor signal 52 towards (e.g., to) a baseline 56 (see FIG. 4). The baseline 56 may be indicative of the baseline velocity and/or the baseline position described above. For example, where the vertical oscillations of the elevator car 24 cause the traction sheave 36 to move in the first direction and increase the sensor signal 52, the controller 50 may signal the motor 42 to rotate the traction sheave 36 in the opposite second direction. Where the vertical oscillations of the elevator car 24 cause the traction sheave 36 to move in the second direction and decrease the sensor signal 52, the controller 50 may signal the motor 42 to rotate the traction sheave 36 in the opposite first direction. In this manner, the elevator drive system 26 using this continuous corrective feedback logic may reduce the amplitude of the changes in the angular velocity and/or position of the traction sheave 36 and thereby actively damp the vertical oscillations of the elevator car 24 as illustrated in FIG. 4. Upon driving the sensor signal 52 to the baseline 56, the controller 50 may subsequently signal the motor 42 to maintain the traction sheave 36 at the baseline velocity and/or position in the manner described above.

Figure 5:
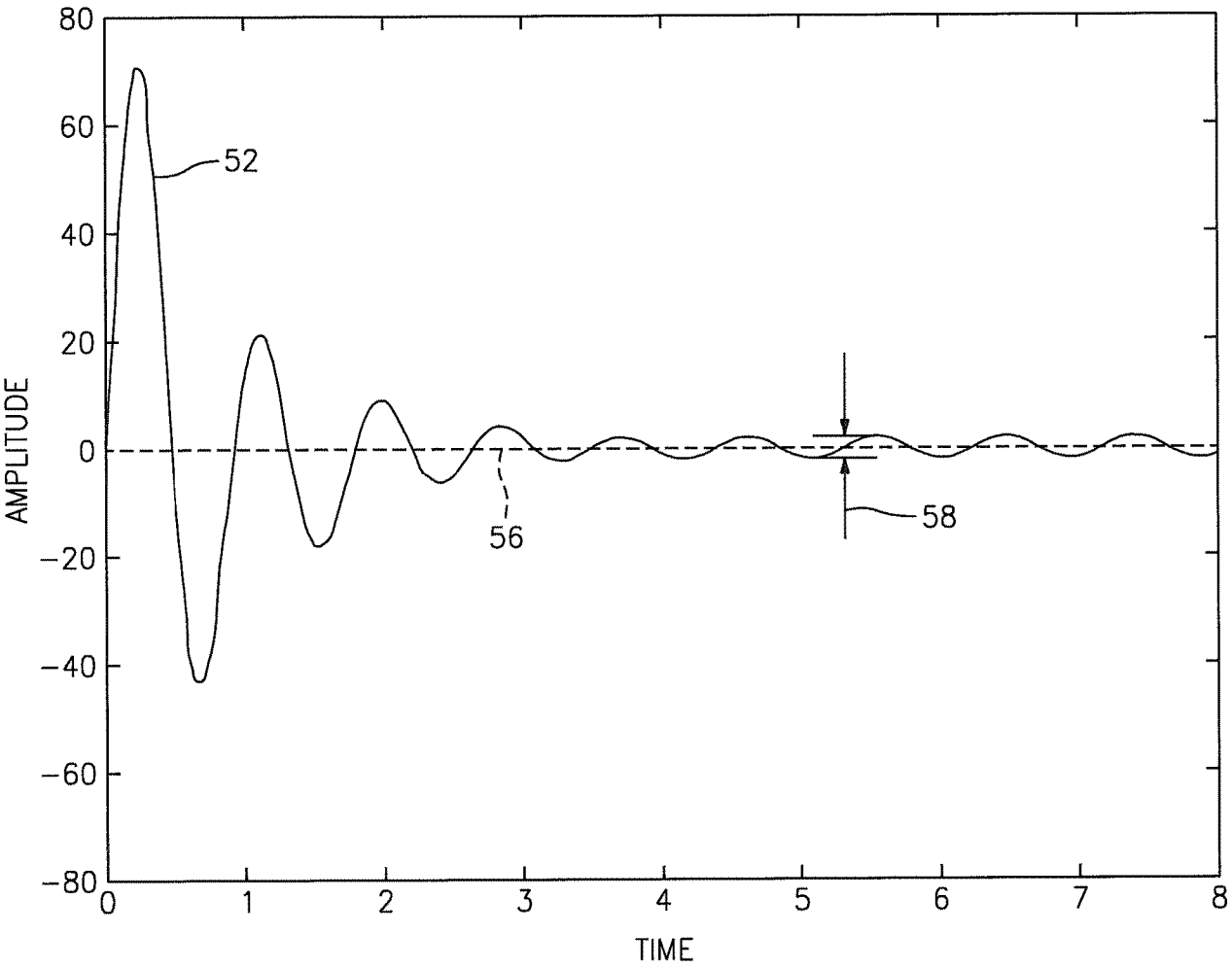
FIG. 5 is a graphical depiction of an amplitude of changes in a traction sheave angular position versus time during another hover mode of operation.

In an alternative embodiment, the controller 50 may signal the motor 42 to maintain the traction sheave 36 about the baseline velocity and/or position during the hover mode. The controller 50, for example, may signal the motor 42 to slightly rotate the traction sheave 36 back and forth about the baseline position. The controller 50 may regulate this slight traction sheave 36 oscillation by driving and/or maintaining the sensor signal 52 within a baseline range 58 that includes the baseline 56 as illustrated in FIG. 5. A non-limiting example of a baseline range is plus and minus about one unit from the baseline 56. By slightly rotating the traction sheave 36, the elevator drive system 26 may reduce the thermal load of the motor 42.

In step 308, the controller 50 signals the elevator machine 32 to drop or otherwise engage the brake 44 with the first control signal 53. The controller 50 may subsequently repeat, or alternatively perform for the first time, the pre-flight checks in order to determine whether the elevator 20 is ready for continued operation.

In step 310, the controller 50 signals the elevator machine 32 to move the elevator car 24 to the elevator landing 28 of another floor. Upon arriving at the next elevator landing 28, the elevator drive system 26 may repeat one or more of the foregoing steps.

The elevator drive system 26 may be operated in various manners other than that described above and illustrated in FIG. 3. In some embodiments, for example, one or both of the braking steps 304 and 308 may be omitted. The elevator drive system 26 therefore may be operated in the hover mode the entire time the elevator car 24 is at the elevator landing 28. In some embodiments, the elevator drive system 26 may perform one or more additional steps. For example, the motor 42 may maintain the traction sheave 36 at the baseline velocity and/or position for a first portion of time, and subsequently slightly rotate the traction sheave 36 for a second portion of time in order to reduce the thermal load of the motor 42. The elevator drive system 26 therefore is not limited to performing any particular operational method steps.

In some embodiments, the controller 50 may signal the elevator machine 32 to drop the brake 44 when the elevator car 24 is stopped at the elevator landing 28 and a door of the elevator car 24 is closed. In contrast, the controller 50 may signal the elevator machine 32 to operate in the hover mode when the door of the elevator car 24 is open. In this manner, the motor 42 is not subject to additional demands when there is little or no potential for load shifts and vertical oscillations of the elevator car 24.

In some embodiments, the controller 50 may signal the elevator machine 32 to drop the brake 44 when the elevator car 24 is stopped at an elevator landing 28 located on an upper floor of the building; e.g., an elevator landing located in a top two thirds of the building. In contrast, the controller 50 may signal the elevator machine 32 to operate in the hover mode at least some of the time or the entire time the elevator car 24 is stopped at an elevator landing 28 located on a lower floor of the building; e.g., an elevator landing located in a bottom one third of the building. In this manner, the motor 42 is not subject to additional demands when there is little or no potential for load shifts and vertical oscillations of the elevator car 24.

In some embodiments, the controller 50 may signal the elevator machine 32 to drop the brake 44 when the elevator car 24 is stopped at the elevator landing 28 and there are relatively little or no vertical oscillations of the elevator car 24. In contrast, the controller 50 may signal the elevator machine 32 to operate in the hover mode where the elevator car 24 is vertically oscillating. The elevator drive system 26, for example, may include an accelerometer arranged with the elevator car 24 and/or any other type of car position sensor. When a signal provided by the accelerometer is within a threshold range and, thus, the there are relatively little or no vertical oscillations of the elevator car 24, the controller 50 may signal the elevator machine 32 to drop the brake 44. When the signal from the accelerometer is outside of the threshold range and, thus, the elevator car 24 is vertically oscillating, the controller 50 may signal the elevator machine 32 to operate in the hover mode to damp the oscillations.

In some embodiments, the controller 50 may signal the elevator machine 32 to drop the brake 44 when the elevator car 24 is stopped at the elevator landing 28 and a change in the overall weight of the elevator car 24 is below a threshold. Such a change in weight may occur when passengers and/or cargo move between the elevator car 24 and the elevator landing 28. In contrast, the controller 50 may signal the elevator machine 32 to operate in the hover mode when the elevator car 24 is stopped at the elevator landing 28 and the change in the overall weight of the elevator car 24 is equal to or above the threshold. This threshold may correspond to, for example, a typical load change that may precipitate the stretching and contracting of the load bearing members 40. The controller 50 may determine the change in the overall weight of the elevator car 24 based on a change in power the elevator machine 32 is drawing, or from a signal provided by a load sensor.

In some embodiments, the controller 50 may signal the elevator machine 32 to drop the brake 44 when the elevator car 24 is stopped at the elevator landing 28 and the elevator drive system 26 has been operating in the hover mode for more than a predetermined period of time. In this manner, the controller 50 may prevent the motor 42 from being over-used and potentially damaged.

A person of skill in the art will recognize the elevator drive system 26 and the foregoing methods of operation may be utilized with various elevator configurations other than the traction elevator 20 described above and illustrated in the drawings. The present invention therefore is not limited to any particular elevator types or configurations.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A system for damping vertical oscillations of an elevator car hovering at an elevator landing, the system comprising:

a traction sheave;

a sensor adapted to provide a sensor signal indicative of rotation of the traction sheave, wherein the rotation of the traction sheave corresponds to the vertical oscillations of the hovering elevator car;

a controller adapted to provide a control signal based on the sensor signal; and an elevator machine connected to the traction sheave, and adapted to reduce the vertical oscillations of the hovering elevator car by controlling the rotation of the traction sheave based on the control signal;

wherein the controlling of the rotation of the traction sheave with the elevator machine drives the sensor signal towards a baseline;

wherein the controlling of the rotation of the traction sheave with the elevator machine drives the sensor signal to within a baseline range that includes the baseline; and wherein the sensor signal oscillates within the baseline range.

2. The system of claim 1, wherein sensor signal is indicative of an angular position of the traction sheave, and the baseline is indicative of an angular baseline position.

3. The system of claim 1, wherein the sensor signal is indicative of an angular velocity of the traction sheave, and the baseline is indicative of a substantially zero angular velocity.

4. The system of claim 1, wherein the controlling of the rotation of the traction sheave with the elevator machine drives the sensor signal to the baseline.

5. The system of claim 1, wherein the elevator machine includes a brake;

the controller is adapted to signal the brake to substantially prevent rotation of the traction sheave where the hovering elevator car is at an upper floor; and the controller is adapted to provide the control signal to the elevator machine where the hovering elevator car is at a lower floor located vertically below the upper floor.

6. The system of claim 1, wherein the elevator machine includes a brake;

the controller is adapted to signal the brake to substantially prevent rotation of the traction sheave where a door of the hovering elevator car is closed; and the controller is adapted to provide the control signal to the elevator machine where the door of the hovering elevator car is open.

7. A system for damping vertical oscillations of an elevator car hovering at an elevator landing, the system comprising:

a traction sheave;

a sensor adapted to provide a sensor signal indicative of rotation of the traction sheave, wherein the rotation of the traction sheave corresponds to the vertical oscillations of the hovering elevator car;

a controller adapted to provide a control signal based on the sensor signal; and an elevator machine connected to the traction sheave, and adapted to reduce the vertical oscillations of the hovering elevator car by controlling the rotation of the traction sheave based on the control signal;

wherein the elevator machine includes a brake; and wherein the controller is adapted to signal the brake to substantially prevent rotation of the traction sheave where the sensor signal is within a threshold range, wherein the controller is adapted to provide the control signal to the elevator machine where the sensor signal is outside of the threshold range; and/or the hovering elevator car is at an upper floor, wherein the controller is adapted to provide the control signal to the elevator machine where the hovering elevator car is at a lower floor located vertically below the upper floor; and/or a door of the hovering elevator car is closed, wherein the controller is adapted to provide the control signal to the elevator machine where the door of the hovering elevator car is open; and/or change in a weight of the hovering elevator car is below a threshold, wherein the controller is adapted to provide the control signal to the elevator machine where the change in the weight of the hovering elevator car is above the threshold; and/or the elevator machine has been controlling the rotation of the traction sheave more than a predetermined period of time.

8. The system of claim 1, wherein the elevator machine includes a brake;

the controller is adapted to signal the brake to substantially prevent rotation of the traction sheave where change in a weight of the hovering elevator car is below a threshold; and the controller is adapted to provide the control signal to the elevator machine where the change in the weight of the hovering elevator car is above the threshold.

9. The system of claim 1, wherein the elevator machine includes a brake; and the controller is adapted to signal the brake to substantially prevent rotation of the traction sheave where the elevator machine has been controlling the rotation of the traction sheave more than a predetermined period of time.

10. The system of claim 1, wherein the sensor comprises at least one of a rotor sensor, a car sensor and a counterweight sensor.

11. A method for damping vertical oscillations of an elevator car hovering at an elevator landing, wherein rotation of a traction sheave connected to an elevator machine corresponds to the vertical oscillations of the hovering elevator car, the method comprising:

receiving a sensor signal indicative of the rotation of the traction sheave;

processing the sensor signal with a controller to provide a control signal to the elevator machine; and reducing the vertical oscillations of the hovering elevator car by controlling the rotation of the traction sheave with the elevator machine based on the control signal;

wherein the controlling of the rotation of the traction sheave with the elevator machine drives the sensor signal towards a baseline;

wherein the controlling of the rotation of the traction sheave with the elevator machine drives the sensor signal to within a baseline range that includes the baseline; and wherein the sensor signal oscillates within the baseline range.

12. The method of claim 11, wherein sensor signal is indicative of an angular position of the traction sheave, and the baseline is indicative of an angular baseline position.

13. The method of claim 11, wherein the sensor signal is indicative of an angular velocity of the traction sheave, and the baseline is indicative of a substantially zero angular velocity.

14. The method of claim 11, wherein the controlling of the rotation of the traction sheave with the elevator machine drives the sensor signal to the baseline.

15. The method of claim 11, further comprising:

substantially preventing rotation of the traction sheave with a brake where the hovering elevator car is at an upper floor;

wherein the elevator machine controls the rotation of the traction sheave based on the control signal where the hovering elevator car is at a lower floor that is located below the upper floor.

16. The method of claim 11, further comprising:

substantially preventing rotation of the traction sheave with a brake where a door of the hovering elevator car is closed;

wherein the elevator machine controls the rotation of the traction sheave based on the control signal where the door of the hovering elevator car is open.

17. A method for damping vertical oscillations of an elevator car hovering at an elevator landing, wherein rotation of a traction sheave connected to an elevator machine corresponds to the vertical oscillations of the hovering elevator car, the method comprising:

receiving a sensor signal indicative of the rotation of the traction sheave;

processing the sensor signal with a contoller to provide a control signal to the elevator machine;

reducing the vertical oscillations of the hovering elevator car by controlling the rotation of the traction sheave with the evaluator machine based on the control signal; and substantially preventing rotation of the traction sheave with a brake where the sensor signal is within a threshold range, wherein the elevator machine controls the rotation of the traction sheave based on the control signal where the sensor signal is outside of the threshold range; and/or the hovering elevator car is at an upper floor, wherein the elevator machine controls the rotation of the traction sheave based on the control signal where the hovering elevator car is at a lower floor that is located below the upper floor; and/or a door of the hovering elevator car is closed, wherein the elevator machine controls the rotation of the traction sheave based on the control signal where the door of the hovering elevator car is open; and/or a change in a weight of the hovering elevator car is below a threshold, wherein the elevator machine controls the rotation of the traction sheave based on the control signal where the change in the weight of the hovering elevator car is above the threshold; and/or the elevator machine has been controlling the rotation of the traction sheave more than a predetermined period of time.

18. The method of claim 11, further comprising:

substantially preventing rotation of the traction sheave with a brake where a change in a weight of the hovering elevator car is below a threshold;

wherein the elevator machine controls the rotation of the traction sheave based on the control signal where the change in the weight of the hovering elevator car is above the threshold.

19. The method of claim 11, further comprising substantially preventing rotation of the traction sheave with a brake where the elevator machine has been controlling the rotation of the traction sheave more than a predetermined period of time.

20. The method of claim 11, wherein the sensor signal is provided by a sensor comprising at least one of a rotor sensor, a car sensor and a counterweight sensor.

* * * * *